US006390307B1

(12) United States Patent
Stelter

(10) Patent No.: US 6,390,307 B1
(45) Date of Patent: May 21, 2002

(54) SECURE HOLDING SYSTEM FOR STANDARDS

(76) Inventor: Stan Stelter, 2070 Emerald La., Eagan, MN (US) 55122

( * ) Notice: Subject to any disclaimer, the term of this patent is extended or adjusted under 35 U.S.C. 154(b) by 0 days.

(21) Appl. No.: 09/859,557

(22) Filed: May 18, 2001

(51) Int. Cl.[7] ..... A47F 5/00

(52) U.S. Cl. ..... 211/60.1; 211/4; 70/58; 248/552

(58) Field of Search ..... 211/60.1, 70.8, 211/4, 68; 70/58; 248/551, 552, 553

(56) References Cited

U.S. PATENT DOCUMENTS 559,193 A * 4/1896 Nelson
1,416,617 A * 5/1922 Cua
2,070,904 A * 2/1937 Jennings ..... 211/64
2,482,240 A * 9/1949 Bowman
2,752,046 A * 6/1956 Levy ..... 211/4
2,854,147 A * 9/1958 Derr ..... 211/70.8
3,421,632 A * 1/1969 Wood
3,635,433 A * 1/1972 Anderson
5,257,700 A * 11/1993 Wallace ..... 211/70.8

* cited by examiner

*Primary Examiner*—Robert W. Gibson, Jr.
(74) *Attorney, Agent, or Firm*—Thomas B. Tate

(57) ABSTRACT

A secure holding system for displaying and securing standards (stands to which nets used for volleyball, tennis, badminton, etc. are attached) when not in use. The system comprises a rack which can be mounted upon a wall, and which has a bottom piece whose front section opens downwardly and forwardly from its stationary back section by means of hinges and stops.

2 Claims, 2 Drawing Sheets

SECURE HOLDING SYSTEM FOR STANDARDS

BACKGROUND OF THE INVENTION

The field of the invention is secure holding systems for standards.

Standards are aluminum poles used to hold nets (for volleyball, tennis, badminton, etc.) in position while those sports are being played. Often the same gymnasium is also used for basketball and other sports that do not require these nets. Therefore the standards must be stored and secured out of the way in order to prevent injuries and theft.

SUMMARY OF THE INVENTION

The invention is a standard secure holder system. The device comprises a rack which can be mounted on a wall off of the floor. The rack has a stationary top piece, and a bottom piece which has a stationary back section and a moveable front section which opens by means of hinges and can be held open at approximately a ninety degree angle by means of stops positioned along the hinges, in order to put the standards into the rack or remove the standards from the rack. Internally there are a series of partitions which form boxes to hold each standard in position. The rack can be locked by means of a hasp and padlock.

An advantage of the invention is that the standards cannot be physically removed while the rack is closed (even if unlocked) because of the tight tolerances of the boxes and the circular openings into which the standards fit, thus providing secure storage.

Another advantage is that all the standards can be seen while in the storage rack, thus allowing them to be counted for easy accountability.

Another advantage is that the standards can be stored off of the playing surface of the gymnasium when not in use (thus reducing the risk of injury) but can be readily accessible when needed.

DETAILED DESCRIPTION OF THE INVENTION

Figure 1:
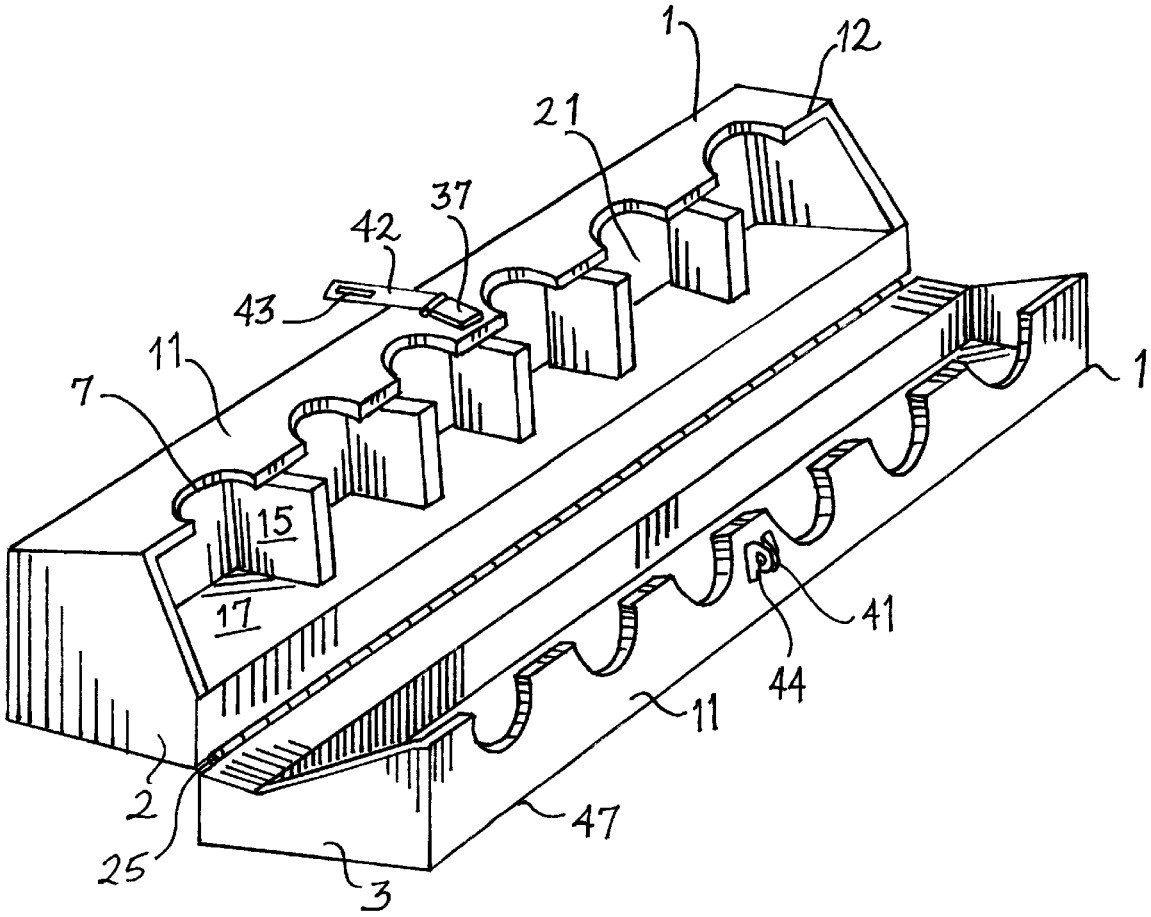
FIG. 1 is a perspective view of the bottom piece in open position, showing the top, end, and inside of the bottom piece.
Figure 2:
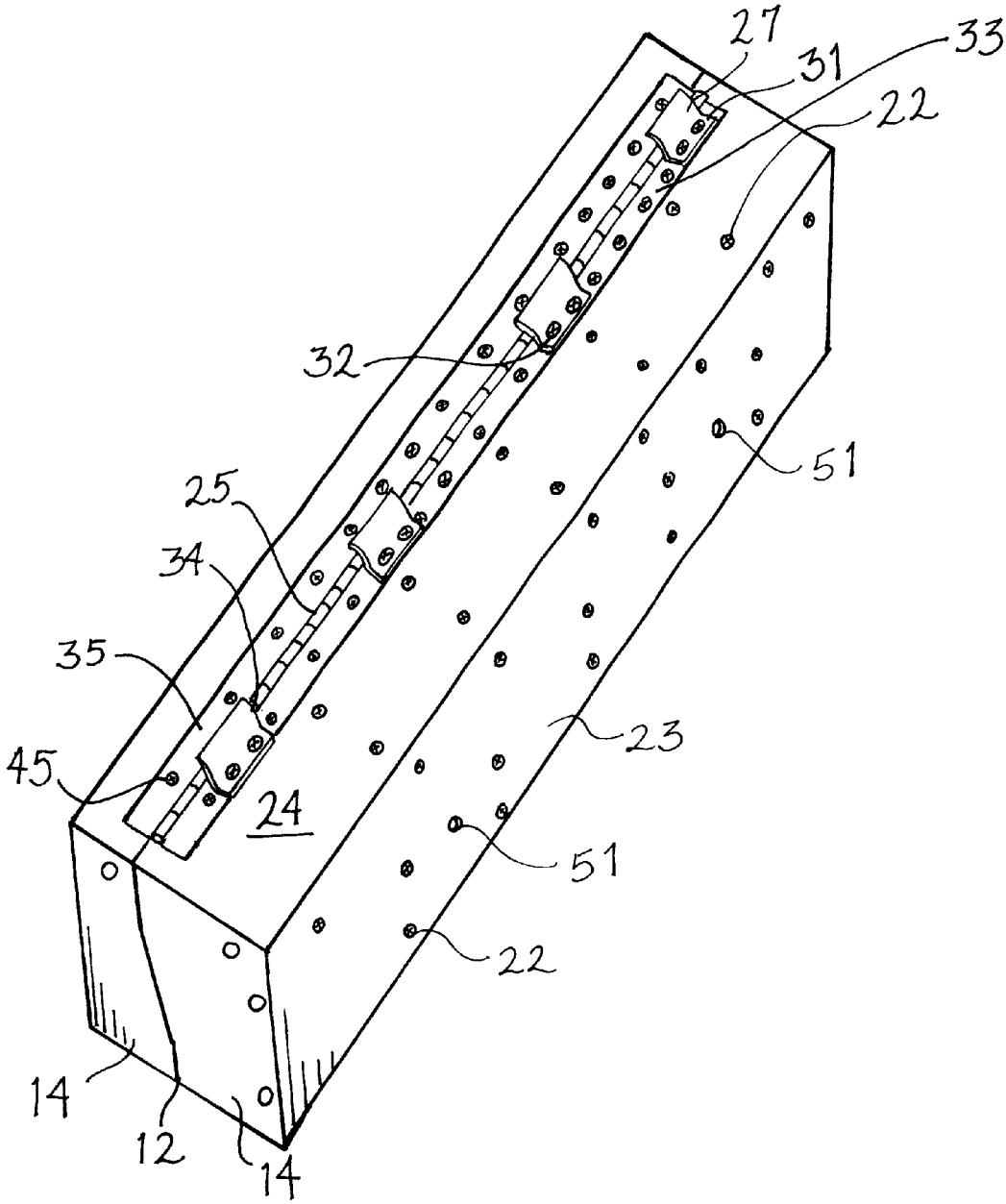
FIG. 2 is a perspective view of the bottom, end, and back of the bottom piece in closed position.

The system has a bottom piece 1 which includes a back section 2 which is stationary and a front section 3 which can be opened forwardly and downwardly from the back section 2. The system also includes a top piece (not shown) which is stationary and which has circular slots in its undersurface for the standards (one slot for each standard). The system can be mounted on the wall of a gymnasium (above the floor, with the top piece and the bottom piece in vertical spaced relationship to each other) by conventional means, such as lead anchors and bolts (not shown) disposed through openings in the top piece and also through the openings 51 in the back section 2 of the bottom piece 1. The standards extend vertically from the top piece to the bottom piece 1 when stored in the system.

The bottom piece 1 has a top panel 11, two end panels 14, a back panel 23, a bottom panel 24, and a front panel 47. The bottom piece 1 has a series of large circular openings 7 formed through its top panel 11. A slot 12 connects the centers of the circular openings 7, forming the dividing line between the back section 2 and the front section 3 of the bottom piece 1. The slot 12 then continues down each end panel 14 of the bottom piece 1, in a zigzag pattern that is vertical for a short distance, then diagonal, then vertical again, so that the slot 12 is off-center on the end panels 14.

The circular openings 7 are of a size that the standards will fit snugly into them when the bottom piece 1 is in the closed position. The number of openings 7 and the overall length of the bottom piece 1 (and top piece) will vary in different models of the system depending upon how many standards are planned to be stored (one standard per opening 7). The model shown in the figures, which has six openings 7, is about four feet long.

Internally, a series of partitions 15 are positioned vertically in the back section 2 of the bottom piece 1, extending from the underside of the top panel 11 to the top surface of the base 17. The number of partitions 15 corresponds to the number of openings 7, and the partitions 15 are located midway between each opening 7. The partitions 15 define a series of boxes 21 (one box for each standard). The ledge 17 which is the base of the back section 2 bears the weight of the standards. A plurality of screws 22 are countersunk into the back panel 23 and the bottom panel 24 of the back section 2, extending into the partitions 15 and the ledge 17 in order to provide additional strength.

A hinge 25 extends along the bottom panel 24 of the bottom piece 1, allowing the front section 3 to be flipped open forwardly and downwardly from the stationary back section 2. The hinge 25 is screwed (by screws 45) to the bottom panel 24 of both the front section 3 and the back section 2. The standards can be removed from, or be placed into, the bottom piece 1 when it is in open position. If the hinge 25 were free swinging, the front section 3 would open to about a one hundred seventy degree angle. However, in order to reduce risk of injury to personnel who are handling the standards, the hinge 25 is designed to open only to an angle of about ninety degrees. This is accomplished by means of a plurality of stops 27 positioned along the hinge 25 to limit its movement. Each stop 27 is formed as a flat piece 31 which is screwed, by means of screws 32, into the plate 33 of the hinge 25 on the back section 2 of the bottom piece 1, and a curved piece 34 which extends above the moveable part of the hinge 25 in spaced relationship thereto and contacts the plate 35 of the hinge 25 on the front section 3 when it is opened to its maximum width.

A hasp 37 is provided for opening and closing the bottom piece 1. The stationary projection 41 of the hasp 37 is mounted on the front section 3. The partially pivotable tongue 42 is mounted on the back section 2, and has an opening 43 into which the projection 41 fits when the bottom piece 1 is in the closed position. A conventional padlock (not shown) can be placed through an opening 44 in the projection 41 if additional security is desired but it is not really necessary due to the difficulty in removing the standards when the bottom piece 1 is in the closed position. To open the front section 3, the tongue 42 of the hasp 37 is flipped upward and backward off of the projection 41.

The top piece and the bottom piece are preferably made of wood. The hinge, stops, and hasp are preferably made of metal.

I claim:

1. A secure holding system for standards, said system comprising:

a stationary top piece mountable upon a wall;

a bottom piece mountable upon a wall in spaced relationship to said top piece such that said standards can be stored in an upright position between said top piece and said bottom piece;

said bottom piece having a top panel with a plurality of generally circular openings defined therethrough and a slot extending through said openings lengthwise, a front panel, a back panel, a bottom panel, and two end panels, each of said end panels having said slot extending therealong in an off-center zigzag pattern to divide said bottom piece into a back section which is stationary and a front section which opens forwardly and downwardly from said back section by hinge means which are mounted along said bottom panel between said back section and said front section;

a plurality of stops mounted on said hinge means to restrict said front section from opening beyond a predetermined angle with said back section.

2. A storage and display rack for sports equipment, which when used in combination with a stationary rack mounted above said storage and display rack can support a plurality of standards securely in a vertical position, said storage and display rack comprising:

a top panel having a plurality of generally circular openings defined therethrough, and a slot extending through said openings lengthwise, a front panel, a back panel, a bottom panel, and two end panels, each of said end panels having said slot extending therealong in an off-center zigzag pattern to divide said storage and display rack into a back section which is stationary and front section which opens forwardly and downwardly from said back section by hinge means which are mounted along said bottom panel between said back section and said front section;

and a plurality of stops mounted on said hinge means to restrict said front section from opening beyond a predetermined angle with said back section.

* * * * *

UNITED STATES PATENT AND TRADEMARK OFFICE

CERTIFICATE OF CORRECTION

PATENT NO. : 6,390,307 B1
DATED : May 21, 2002
INVENTOR(S) : Stan Stelter

It is certified that error appears in the above-identified patent and that said Letters Patent is hereby corrected as shown below:

Title page,
Item [76], the Inventor's street address should read:
-- 2078 Emerald La. --

Signed and Sealed this

Eighth Day of October, 2002

*Attest:*

*Attesting Officer*

JAMES E. ROGAN
*Director of the United States Patent and Trademark Office*